US011264719B2

(12) United States Patent
Heo et al.

(10) Patent No.: US 11,264,719 B2
(45) Date of Patent: Mar. 1, 2022

(54) RADIO FREQUENCY MODULE

(71) Applicant: Samsung Electro-Mechanics Co., Ltd., Suwon-si (KR)

(72) Inventors: Shin Haeng Heo, Suwon-si (KR); Young Sik Hur, Suwon-si (KR); Hak Gu Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/890,060

(22) Filed: Jun. 2, 2020

(65) Prior Publication Data

US 2021/0257736 A1 Aug. 19, 2021

(30) Foreign Application Priority Data

Feb. 18, 2020 (KR) ..... 10-2020-0019487

(51) Int. Cl.

| | |
|---|---|
| ***H01Q 9/04*** | (2006.01) |
| ***H01Q 1/22*** | (2006.01) |
| ***H01Q 1/38*** | (2006.01) |
| ***H01Q 21/28*** | (2006.01) |

(52) U.S. Cl.

CPC ..... *H01Q 9/0407* (2013.01); *H01Q 1/2283* (2013.01); *H01Q 1/38* (2013.01); *H01Q 21/28* (2013.01)

(58) Field of Classification Search

CPC ..... H01Q 9/0407; H01Q 1/38; H01Q 1/2283; H01Q 21/28

See application file for complete search history.

(56) References Cited

U.S. PATENT DOCUMENTS

| | | | | |
|---|---|---|---|---|
| 7,692,295 | B2 | 4/2010 | Megahed | |
| 9,246,209 | B2 * | 1/2016 | Han | H01Q 9/0407 |
| 10,269,769 | B2 | 4/2019 | Frenette et al. | |
| 10,317,512 | B2 * | 6/2019 | Trotta | H01Q 9/0407 |
| 10,515,924 | B2 * | 12/2019 | Babcock | H01L 24/73 |
| 2015/0263421 | A1 * | 9/2015 | Chiu | H01L 23/552 343/702 |

FOREIGN PATENT DOCUMENTS

KR 10-0728529 B1 6/2007

* cited by examiner

*Primary Examiner* — Seung H Lee
(74) *Attorney, Agent, or Firm* — NSIP Law

(57) ABSTRACT

A radio frequency module includes an interposer having a stack structure in which at least one insulating layer and at least one wiring layer are alternately stacked; a radio frequency IC disposed on a first surface of the interposer; a front-end IC disposed on a second surface of the interposer opposite to the first surface; and electrical connection structures arranged to surround the front-end IC and having at least a portion electrically connected to the least one wiring layer. The radio frequency IC inputs or outputs a base signal and a first radio frequency signal having a frequency higher than a frequency of the base signal through the at least one wiring layer, and the front-end IC inputs or outputs the first radio frequency signal and a second radio frequency signal having power different from power of the first radio frequency signal.

19 Claims, 17 Drawing Sheets

RADIO FREQUENCY MODULE

CROSS-REFERENCE TO RELATED APPLICATION(S)

This application claims the benefit under 35 USC 119(a) of Korean Patent Application No. 10-2020-0019487 filed on Feb. 18, 2020 in the Korean Intellectual Property Office, the entire disclosure of which is incorporated herein by reference for all purposes.

BACKGROUND

1. Field

The following description relates to a radio frequency module.

2. Description of Background

Mobile communications data traffic has increased on an annual basis. Various techniques have been developed to support rapidly increasing data in wireless networks in real time. For example, conversion of Internet of Things (IoT)-based data into contents, augmented reality (AR), virtual reality (VR), live VR/AR linked with SNS, an automatic driving function, applications such as a sync view (transmission of real-time images from a user's viewpoint using a compact camera), and the like, may require communications (e.g., 5G communications, mmWave communications, and the like) which support the transmission and reception of large volumes of data.

Accordingly, there has been a large amount of research on mmWave communications including 5th generation (5G), and the research into the commercialization and standardization of a radio frequency module for implementing such communications has been increasingly conducted.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

In one general aspect, a radio frequency module includes an interposer having a stack structure in which at least one insulating layer and at least one wiring layer are alternately stacked; a radio frequency IC disposed on a first surface of the interposer; a front-end IC disposed on a second surface of the interposer opposite to the first surface; and electrical connection structures arranged to surround the front-end IC and having at least a portion electrically connected to the least one wiring layer. The radio frequency IC is configured to input or output a base signal and a first radio frequency signal having a frequency higher than a frequency of the base signal through the at least one wiring layer, and the front-end IC is configured to input or output the first radio frequency signal and a second radio frequency signal having power different from power of the first radio frequency signal.

Each of the electrical connection structures may have a spherical shape or an atypical spherical shape, and a thickness of the FEIC may be less than a thickness of each of the electrical connection structures.

The radio frequency module may include mount electrical connection structures disposed on the first surface of the interposer and electrically connecting the at least one wiring layer to the RFIC. A size of each of the electrical connection structures may be greater than a size of each of the mount electrical connection structures.

The radio frequency module may include a core member surrounding the FEIC and including a core via. At least one of the electrical connection structures may be electrically connected to the core via on a surface of the core member.

The FEIC may be configured to input or output the first and second RF signals in a direction opposite to the RFIC.

The radio frequency module may include a heat dissipation member disposed on a surface of the RFIC opposite to the interposer; and heat dissipation electrical connection structures arranged on a surface of the heat dissipation member opposite to the RFIC.

The radio frequency module may include a second FEIC surrounded by the electrical connection structures and configured to input or output a third RF signal and a fourth RF signal having power different from power of the third RF signal.

The radio frequency module may include a passive component disposed on the first surface of the interposer.

At least a portion of the FEIC may overlap at least a portion of the RFIC in a direction orthogonal to the first and second surfaces of the interposer.

In another general aspect, a radio frequency module includes a radio frequency IC configured to input or output a base signal and a first radio frequency signal having a frequency higher than a frequency of the base signal; a front-end IC configured to input or output the first radio frequency signal and a second radio frequency signal having power different from power of the first radio frequency signal; an interposer disposed between the RFIC and the FEIC and having a stack structure in which at least one insulating layer and at least one wiring layer are alternately stacked; a substrate disposed on a first surface of the interposer and having a first surface adjacent to the first surface of the interposer, the first surface of the substrate having a larger surface area than a surface area of the first surface of the interposer; and electrical connection structures electrically connecting the interposer to the substrate.

The substrate may include a patch antenna pattern configured to transmit or receive the second RF signal; and a feed via configured to feed power to the patch antenna pattern.

The radio frequency module may include an antenna component disposed on a second surface of the substrate opposite to the first surface of the substrate. The antenna component may include a patch antenna pattern configured to transmit or receive the second RF signal; a feed via configured to feed power to the patch antenna pattern; and a dielectric body surrounding the feed via.

The radio frequency module may include a power management integrated circuit (PMIC) disposed on the first surface of the substrate and configured to supply power to one or both of the FEIC and the RFIC through the substrate.

The radio frequency module may include mount electrical connection structures electrically connecting the FEIC to the substrate or electrically connecting the RFIC to the interposer, and a size of each of the electrical connection structures may be greater than a size of each of the mount electrical connection structures.

The radio frequency module may include a sub-substrate disposed on the first surface of the substrate and surrounding the interposer; and outer electrical connection structures disposed on a surface of the sub-substrate opposite to the first surface of the substrate.

The radio frequency module may include a core member including a core via and surrounding the FEIC or the RFIC, and the electrical connection structures may be disposed between the core member and the substrate.

The radio frequency module may include an encapsulant disposed on the first surface of the substrate and encapsulating at least a portion of the FEIC or the RFIC, and at least a portion of a space between the core member and the FEIC or the RFIC is filled with air.

The radio frequency module may include a heat dissipation member disposed on a surface of the RFIC or the FEIC opposite to the interposer; heat dissipation electrical connection structures disposed on a surface of the heat dissipation member opposite to the RFIC or the FEIC; and an encapsulant disposed on the first surface of the substrate and encapsulating at least a portion of the RFIC or at least a portion of the FEIC.

The radio frequency module may include a connector disposed on the first surface of the substrate and configured to be connected to a cable.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
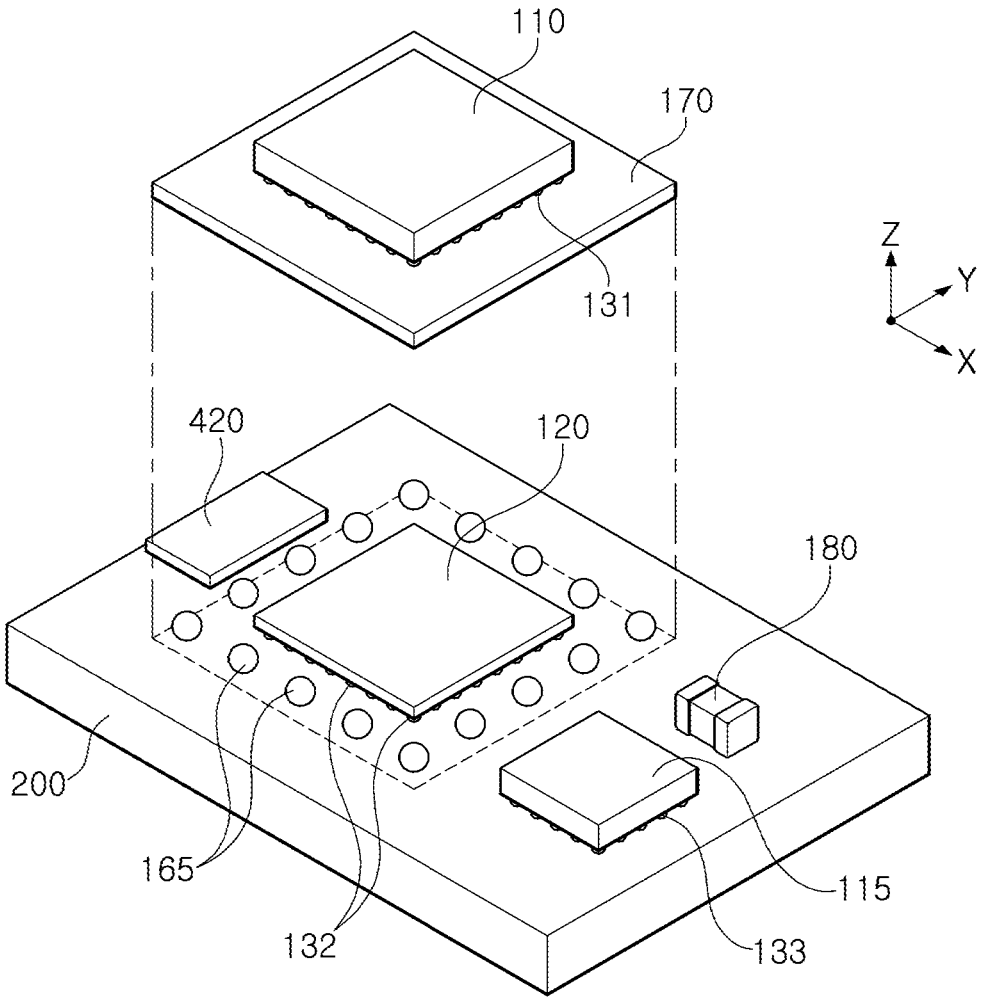
FIG. 1 is a perspective view illustrating a radio frequency module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has"

specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative size, proportions, and depiction of elements in the drawings may be exaggerated for clarity, illustration, and convenience.

FIG. 1 is a perspective view illustrating a radio frequency module according to an example.

Referring to FIG. 1, a radio frequency module may include a radio frequency integrated circuit (RFIC) 110 and a front-end integrated circuit (FEIC) 120.

The RFIC 110 may input and/or output a base signal and a first radio frequency (RF) signal having a frequency higher than a frequency of the base signal.

For example, the RFIC 110 may generate the first RF signal by processing (e.g., frequency conversion, filtering, a phase control, or the like) the base signal, and may generate the base signal by processing the first RF signal.

The FEIC 120 may input and/or output the first RF signal and a second radio frequency signal having power different from power of the first RF signal.

For example, the FEIC 120 may generate a second radio frequency signal by amplifying the first RF signal, and may generate the first RF signal by amplifying the second radio frequency signal. The amplified second radio frequency signal may be remotely transmitted by an antenna, and the second radio frequency signal remotely received from an antenna may be amplified by the FEIC 120.

For example, the FEIC 120 may include at least a portion of a power amplifier, a low noise amplifier, and a transmission/reception conversion switch. The power amplifier, the low noise amplifier, and the transmission/reception conversion switch may be implemented by combination of a semiconductor transistor element and an impedance element, but embodiment configuration thereof is not limited thereto.

As the FEIC 120 may amplify the first RF signal and/or a second RF signal, the RFIC 110 may not include a front-end amplifier circuit (e.g., a power amplifier, or a low noise amplifier).

It may be more difficult to secure performance (e.g., power consumption, linearity, noise properties, a gain, or the like) of the front-end amplifier circuit than to secure performance of a circuit for performing operations other than amplification in the RFIC 110. Accordingly, compatibility with a circuit for performing operations other than amplification in the RFIC 110 may be relatively low.

For example, the front-end amplifier circuit may be implemented, not by a CMOS based IC, but by a different type of IC (e.g., a compound semiconductor), may be configured to have a structure effective for receiving impedance of a passive component, or may be separately implemented by being optimized to specifically required performance, thereby securing performance.

Accordingly, the radio frequency module in the example may have a structure in which the FEIC 120 for performing a front-end amplification operation and the RFIC 110 for performing an operation other than the front-end amplification operation may be separately implemented, thereby securing both the performance of an amplifier circuit and the performance of a circuit for performing operations other than a front-end amplification operation of the RFIC 110.

Also, power consumption and/or heat dissipation of the front-end amplifier circuit may be greater than power consumption and/or heat dissipation of the circuit for performing operations other than a front-end amplification operation of the RFIC 110.

As the radio frequency module in the example has a structure in which the FEIC 120 for performing a front-end amplification operation and the RFIC 110 for performing an operation other than the front-end amplification operation are separately implemented, the radio frequency module may have increased efficiency in power consumption, and may effectively distribute a heat dissipation path.

The greater the power of the first RF signal and/or the second RF signal, the greater the energy loss of when the first RF signal and/or the second RF signal are transmitted. As the FEIC 120 for performing a front-end amplification operation and the RFIC 110 for performing operations other than the front-end amplification operation are separately implemented, the FEIC 120 may be more adjacently connected to an antenna electrically such that an electrical length of a transmission path of a finally amplified second RF signal to an antenna may easily be reduced, and energy efficiency of the radio frequency module in the example embodiment may improve.

Although an entire size of the RFIC 110 and the FEIC 120 may be greater than a size of an RFIC integrated with a front-end amplifier circuit, the radio frequency module in the example may have a structure in which the RFIC 110 and the FEIC 120 may be disposed compressively.

Referring to FIG. 1, the radio frequency module may include an interposer 170 and a plurality of electrical connection structures 165.

The interposer 170 may have a stack structure in which at least one insulating layer and at least one wiring layer are alternately stacked. For example, the stack structure may be similar to a stack structure of a printed circuit board.

The RFIC 110 may be disposed on an upper surface of the interposer 170, and the FEIC 120 may be disposed on a lower surface of the interposer 170. For example, at least a portion of the FEIC 120 may overlap the RFIC 110 in upward and downward directions (e.g., z direction).

Accordingly, as the RFIC 110 and the FEIC 120 are disposed compressively, a substantially size of the radio frequency module in the example may be reduced, and the size may be less than a size of a radio frequency module including an RFIC integrated with a front-end amplifier circuit.

Also, as the interposer 170 is disposed between the RFIC 110 and the FEIC 120, electromagnetic isolation between the RFIC 110 and the FEIC 120 may improve.

Also, heat generated from the RFIC 110 may be dissipated in an upward direction, and heat generated from the FEIC 120 may be dissipated in a downward direction. Accordingly, a heat dissipation path of the radio frequency module in the example may be effectively distributed.

For example, the interposer 170 may be placed in a region of an upper surface of a substrate 200 in which the plurality of electrical connection structures 165 are disposed, while the RFIC 110 is mounted on an upper surface of the interposer 170.

The plurality of electrical connection structures 165 may be arranged to surround the FEIC 120 and may be electrically connected to the interposer 170.

Accordingly, the RFIC 110 may be electrically connected to the FEIC 120 through the interposer 170 and the plurality of electrical connection structures 165, an electrical length between the RFIC 110 and the FEIC 120 may be reduced, and transmission loss of the first RF signal may be reduced.

For example, the plurality of electrical connection structures 165 may be implemented as a solder ball, a pad, or a land, and at least a portion of the plurality of electrical connection structures 165 may include a material (e.g., tin or tin alloys) having a melting point lower than a melting point of a wiring layer of the interposer 170.

Referring to FIG. 1, the radio frequency module may further include a plurality of first mount electrical connection structures 131 and a plurality of second mount electrical connection structures 132.

The plurality of first mount electrical connection structures 131 may be disposed on an upper surface of the interposer 170, may electrically connect the RFIC 110 to the interposer 170, may provide a path through which the base signal and the first RF signal may move, and may support the RFIC 110.

The plurality of second mount electrical connection structures 132 may be disposed on an upper surface of the substrate 200, may electrically connect the FEIC 120 to the substrate 200, may provide a path through which the first RF signal and the second RF signal may move, and may support the FEIC 120.

A size of each of the plurality of first mount electrical connection structures 131 may be smaller than a size of each of the plurality of electrical connection structures 165.

Accordingly, in the example, a height of the radio frequency module in upward and downward directions (e.g., z direction) may easily be reduced.

A size of each of the plurality of second mount electrical connection structures 132 may be smaller than a size of each of the plurality of electrical connection structures 165.

Accordingly, the plurality of electrical connection structures 165 may directly support the interposer 170, and may support the interposer 170 without an additional medium such as a core member.

For example, each of the plurality of electrical connection structures 165 may have a spherical shape or an atypical spherical shape, and may have a diameter longer than a thickness of the FEIC 120 in upward and downward directions (e.g., z direction).

As a size of the FEIC 120 is smaller than a size of the RFIC 110, the FEIC 120 may easily be disposed in a space formed between the interposer 170 and the substrate 200 by the plurality of electrical connection structures 165. Accordingly, when the FEIC 120 is disposed on a level lower than a level of the RFIC 110, an excessive increase of a size of each of the plurality of electrical connection structures 165 may be prevented, and a height of the radio frequency module in upward and downward directions (e.g., z direction) may easily be reduced.

For example, the first and second mount electrical connection structures 131 and 132 may be implemented as a solder ball, a pad, or a land, and may be implemented similarly to the plurality of electrical connection structures 165.

Referring to FIG. 1, the radio frequency module may further include at least one of a power management integrated circuit (PMIC) 115, a passive component 180, the substrate 200, and a connector 420.

The PMIC 115 may be mounted on an upper surface of the substrate 200 through a plurality of third mount electrical connection structures 133, and may supply power to at least one of the RFIC 110 and the FEIC 120.

The passive component 180 may be disposed on an upper surface of the substrate 200, and may provide impedance to at least one of the RFIC 110 and the FEIC 120. For example, the passive component 180 may be configured as a multilayer ceramic capacitor or a power inductor.

The substrate 200 may have an upper surface (upper surface area) greater than a lower surface (lower surface area) of the interposer 170, and may have a stack structure in which the at least one insulating layer and the at least one wiring layer are alternately stacked to provide a path through which the base signal and the second RF signal are transferred. For example, the stack structure may be similar to a stack structure of a printed circuit board.

The connector 420 may be configured to be connected to a cable to transmit the base signal to an external entity of the radio frequency module or to receive the base signal from the external entity. For example, the cable may be implemented by a coaxial cable.

When the radio frequency module includes the connector 420, the radio frequency module may not include a sub-substrate. When the radio frequency module includes the sub-substrate, the radio frequency module may not include the connector 420.

Figure 2A:
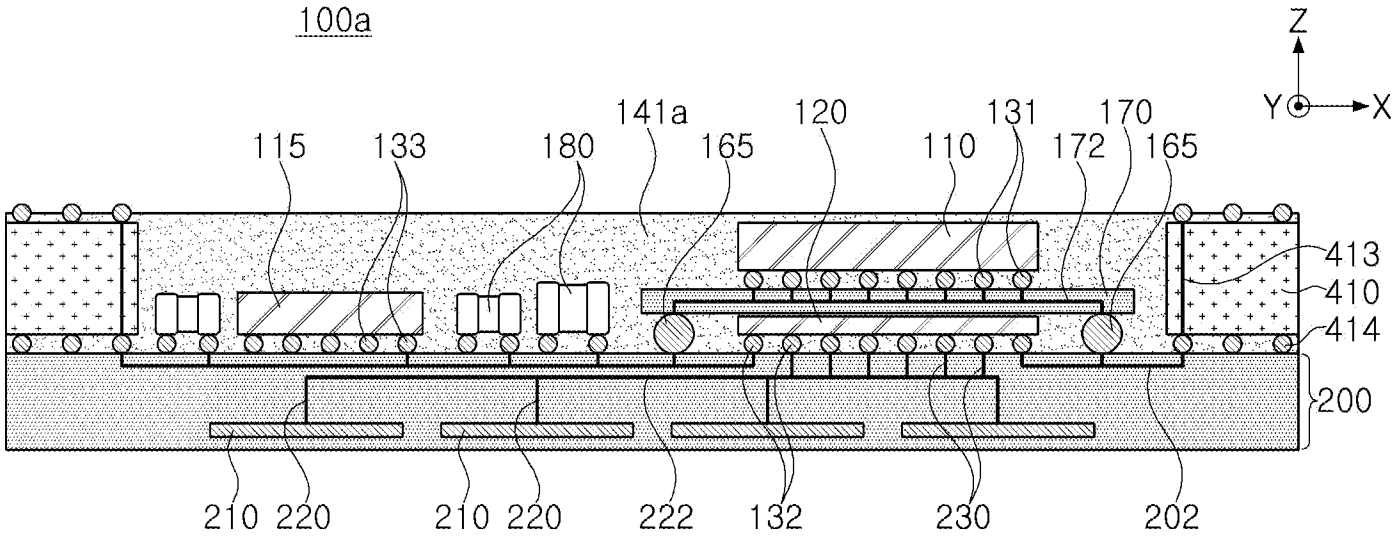
FIGS. 2A and 2B are lateral views illustrating a radio frequency module according to an example.
Figure 2B:
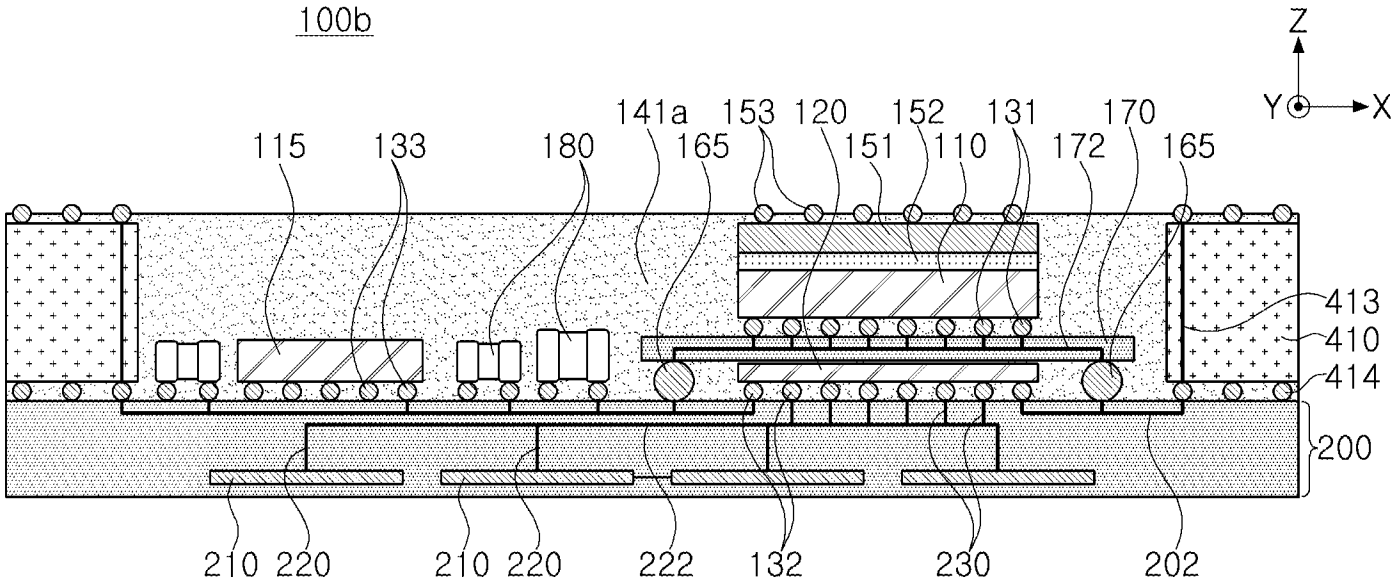

FIGS. 2A and 2B are lateral views illustrating a radio frequency module according to various examples. Description of some elements with like reference numerals to FIG. 1 may be omitted hereafter.

Referring to FIGS. 2A and 2B, radio frequency modules 100*a* and 100*b* may further include a sub-substrate 410.

The sub-substrate 410 may include a sub-via 413 through which a base signal passes, and may be mounted on an upper surface of the substrate 200 through a plurality of outer electrical connection structures 414. The plurality of outer electrical connection structures 414 may be disposed on a lower surface of the sub-substrate 410 and also on an upper surface of the sub-substrate 410, and may electrically connect the sub-substrate 410 to a base substrate.

For example, the sub-substrate 410 may have a structure in which the at least one insulating layer and the at least one wiring layer are alternately stacked, and the sub-via 413 may electrically connect the plurality of wiring layers to each other. The stack structure may be similar to a stack structure of a printed circuit board.

The base signal may be transferred to a first wiring layer 202 of the substrate 200 through the plurality of outer electrical connection structures 414 and the sub-via 413, and may be transferred to the RFIC 110 through the plurality of electrical connection structures 165 and a wiring layer 172 of the interposer 170. As the first wiring layer 202 of the substrate 200 may be electrically connected to the PMIC 115 and/or the passive component 180, the first wiring layer 202 may electrically connect the PMIC 115 and/or the passive component 180 to the FEIC 120 and/or the RFIC 110.

The first RF signal may be transferred from the RFIC 110 to the FEIC 120 through the wiring layer 172 of the interposer 170, the plurality of electrical connection structures 165, and the first wiring layer 202 of the substrate 200.

The FEIC 120 may input or output the first and second RF signals in a downward direction (e.g., a −z direction).

Accordingly, complexity of wirings of the interposer 170 may be reduced such that the interposer 170 may stably provide a dispositional space of a wiring electrically connected to the RFIC 110. Electromagnetic isolation between the RFIC 110 and the FEIC 120 may also improve.

The second RF signal may be transferred from the FEIC 120 to a plurality of feed vias 220 through a plurality of wiring vias 230 and a second wiring layer 222, and may be remotely transmitted through a plurality of patch antenna patterns 210 in the −z direction. Each of the plurality of wiring vias 230 and the plurality of feed vias 220 may be configured to extend in a direction (e.g., a z direction) perpendicular to the plurality of wiring layers of the substrate 200 to electrically connect the plurality of wiring layers of the substrate 200 to each other.

The plurality of patch antenna patterns 210 may be fed with power from the plurality of feed vias 220, may form a radiation pattern in the −z direction, and may remotely transmit or receive the second RF signal. A transmitted second RF signal and a received second RF signal may be transferred in opposite directions.

For example, each of the plurality of patch antenna patterns 210 may be implemented by being patterned to form a polygonal shape or a circular shape in one of the plurality of wiring layers of the substrate 200.

An encapsulant 141*a* may encapsulate at least a portion of the RFIC 110 on an upper surface of the substrate 200. Accordingly, the radio frequency modules 100*a* and 100*b* may have improved protection performance against external impacts, and may be stably disposed on a base substrate. For example, the encapsulant 141*a* may permeate up to the FEIC 120 through a space between the plurality of electrical connection structures 165.

Referring to FIG. 2B, the radio frequency module 100*b* may further include a heat dissipation member 151, an adhesive member 152, and/or a plurality of heat dissipation electrical connection structures 153.

The heat dissipation member 151 may be disposed on an upper surface of the RFIC 110. For example, the heat dissipation member 151 may be implemented by a metal slug having relatively high thermal conductivity, such as copper, and may emit heat generated from the RFIC 110.

The adhesive member 152 may include a material (e.g., polymer) having relatively high adhesiveness to improve adhesiveness between the RFIC 110 and the heat dissipation member 151.

The plurality of heat dissipation electrical connection structures 153 may be disposed on an upper surface of the heat dissipation member 151, may be arranged side by side with the plurality of outer electrical connection structures 414 disposed on an upper surface of the sub-substrate 410, and may be electrically connected to the base substrate (not shown) such that the plurality of heat dissipation electrical connection structures 153 may effectively transfer heat from the heat dissipation member 151 to the base substrate. For example, the plurality of heat dissipation electrical connection structures 153 may be implemented similarly to the plurality of outer electrical connection structures 414.

Figure 3A:
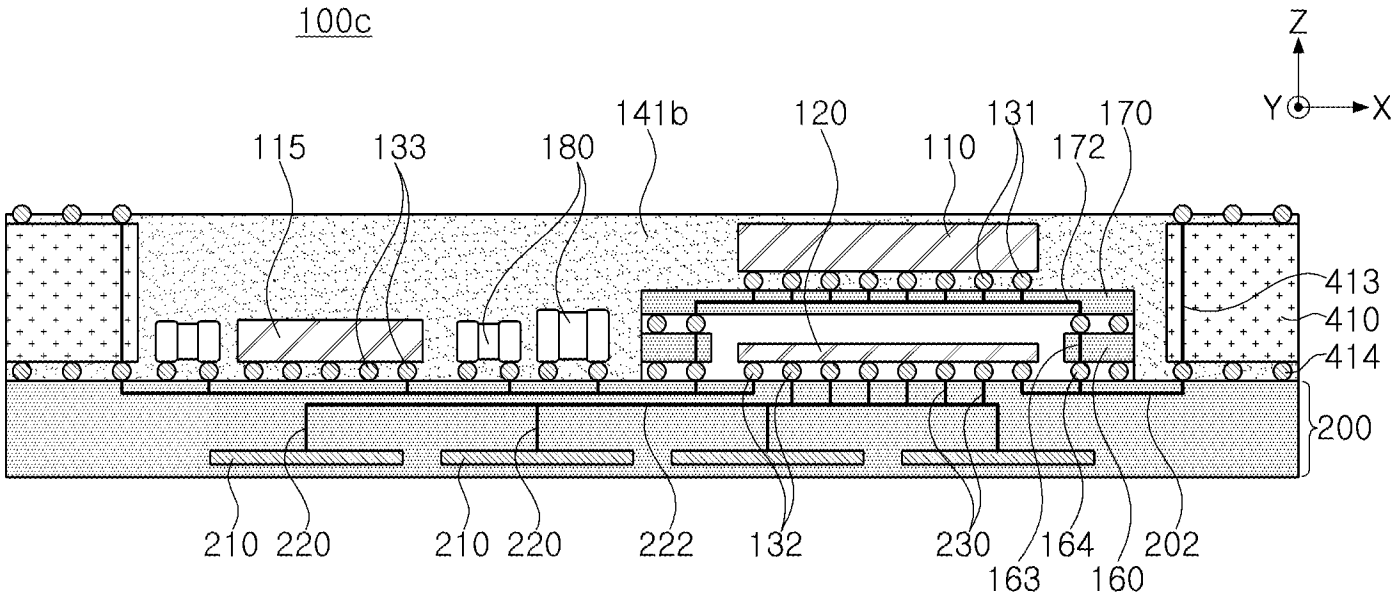
FIGS. 3A and 3B are lateral views illustrating a radio frequency module further including a core member according to an example.
Figure 3B:
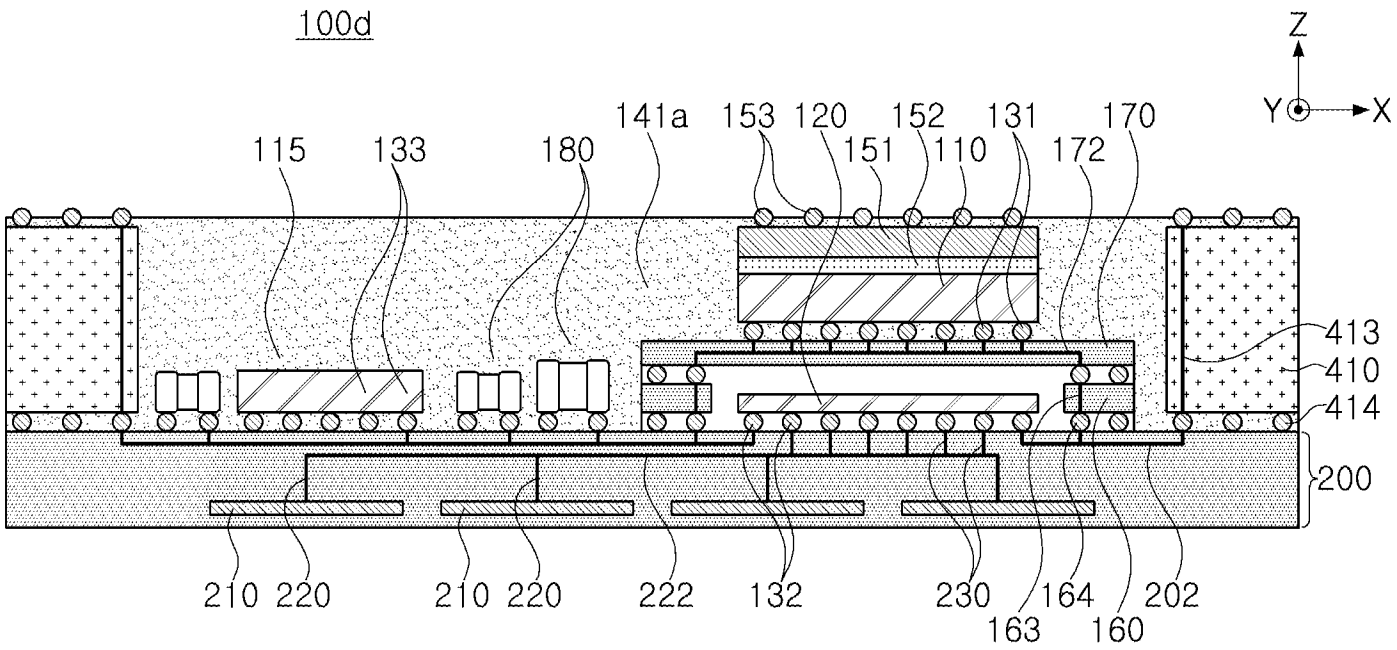

FIGS. 3A and 3B are lateral views illustrating a radio frequency module further including a core member according to various examples. Description of some elements with like reference numerals to the figures discussed above may be omitted hereafter.

Referring to FIGS. 3A and 3B, radio frequency modules 100*c* and 100*d* may further include a core member 160.

The core member 160 may further include a core via 163 and may surround an FEIC 120. For example, the core member 160 may have a stack structure in which at least one insulating layer and the at least one wiring layer are alternately stacked, and the core via 163 may electrically connect a plurality of wiring layers to each other. The stack structure may be similar to a stack structure of a printed circuit board.

For example, the core member 160 may be implemented by removing a space in which the FEIC 120 is disposed while the at least one insulating layer and the at least one wiring layer are alternately stacked. Removing the space may be implemented by applying force to the space, by irradiating laser beams to the space, or by allowing a plurality of microparticles to the space, but an implementation thereof is not limited thereto.

A plurality of electrical connection structures 164 may be disposed on an upper surface and/or a lower surface of the core member 160, and may electrically connect the interposer 170 to the substrate 200 through the core via 163.

Accordingly, the radio frequency module 100*c* may stably provide a dispositional space of the FEIC 120 even though a size of the FEIC 120 is greater than a size of the FEIC illustrated in FIG. 2A.

An encapsulant 141*b* may encapsulate at least a portion of the RFIC 110 on an upper surface of the substrate 200, and may not be in contact with the FEIC 120. Accordingly, a peripheral space of the FEIC 120 may be filled with air.

Referring to FIG. 3B, the radio frequency module 100*d* may further include a heat dissipation member 151, an adhesive member 152, and/or a plurality of heat dissipation electrical connection structures 153.

FIGS. 4A to 4D are lateral views illustrating a radio frequency module which does not include a sub-substrate. Description of some elements with like reference numerals to the figures discussed above may be omitted hereafter.

Referring to FIGS. 4A to 4D, each of radio frequency modules 100*e*, 100*f*, 100*g*, and 100*h* may not include a sub-substrate, and may further include a connector 420 disposed on an upper surface of a substrate 200.

Figure 4A:
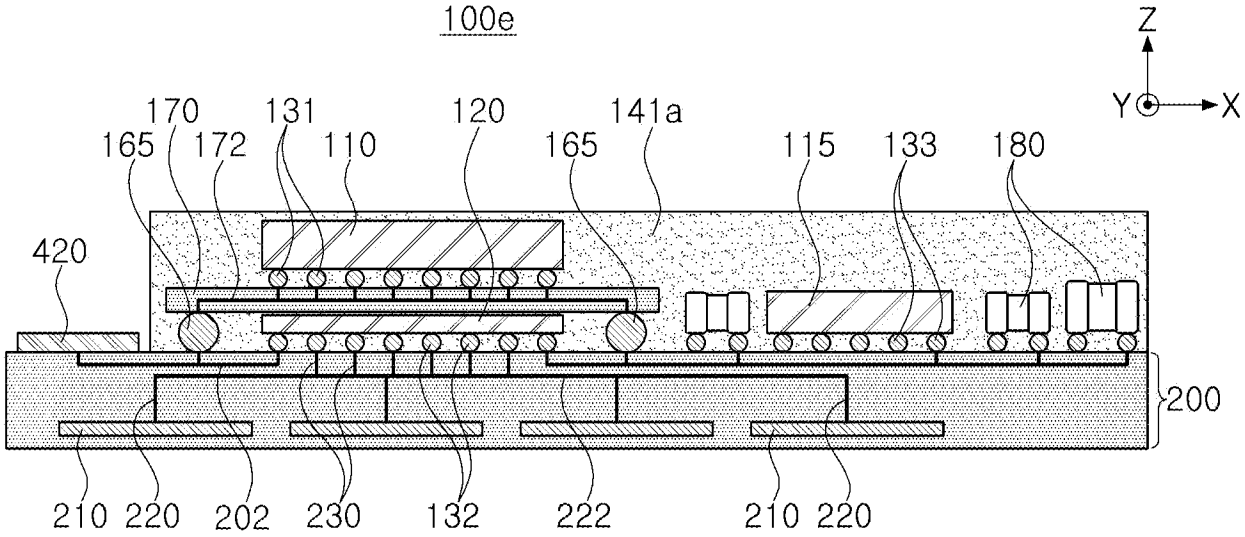
FIGS. 4A, 4B, 4C, and 4D are lateral views illustrating a radio frequency module which does not include a sub-substrate according to an example.
Figure 4B:
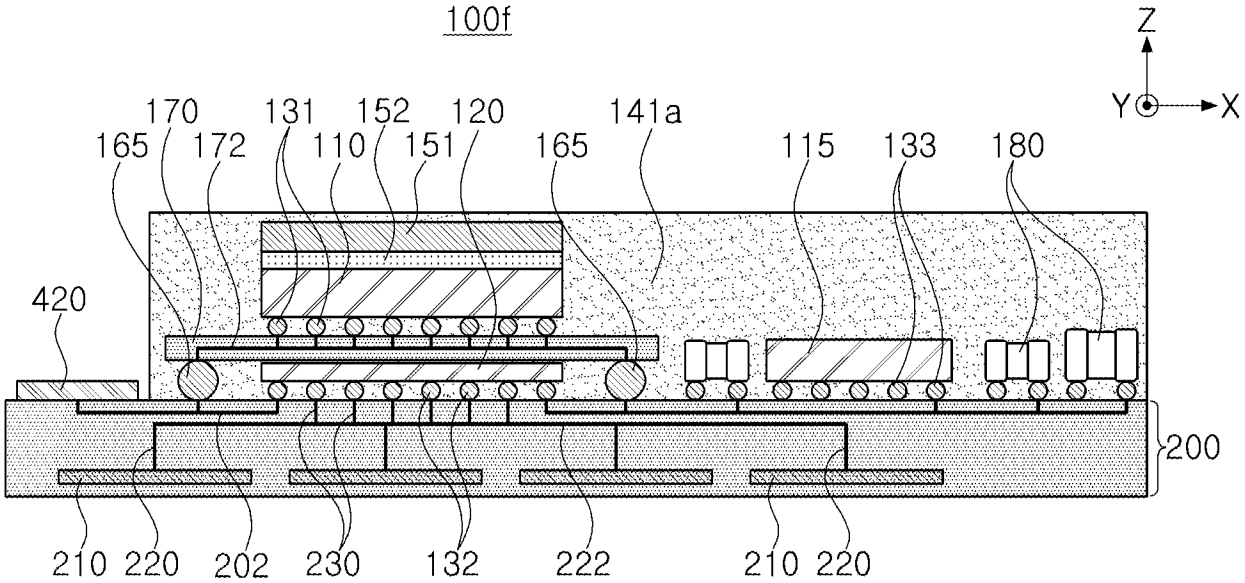

Referring to FIGS. 4A and 4B, each of the radio frequency modules 100*e* and 100*f* may include a plurality of electrical connection structures 165 each having a relatively large size.

Figure 4C:
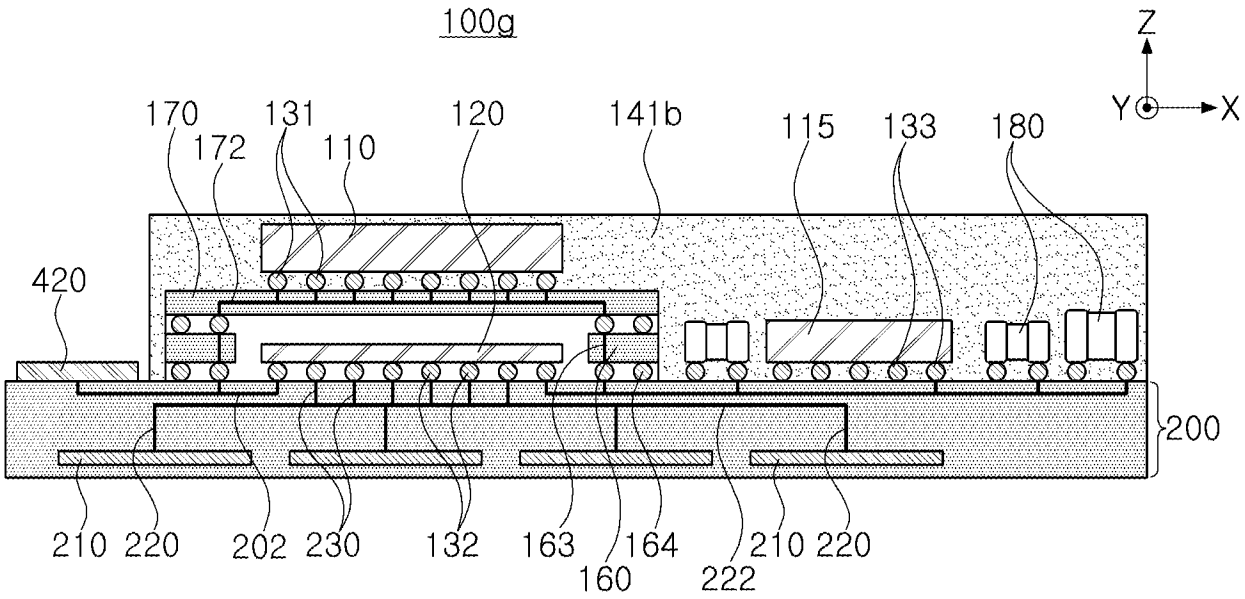
Figure 4D:
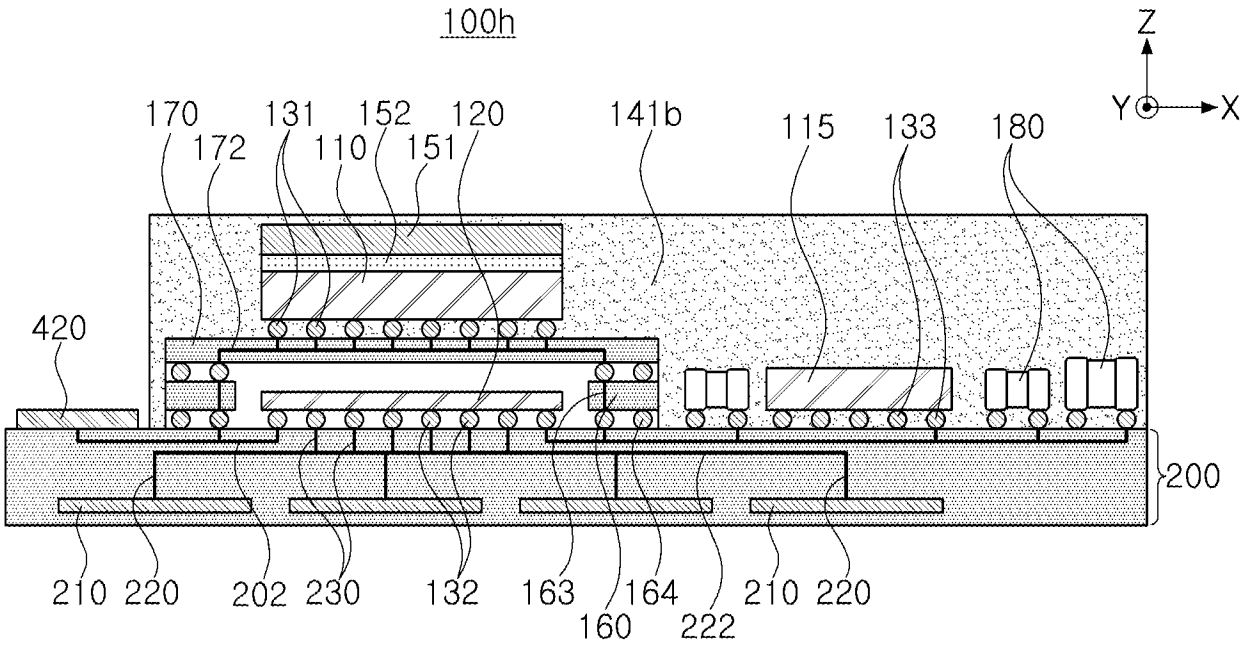

Referring to FIGS. 4C and 4D, each of the radio frequency modules 100*g* and 100*h* may include a plurality of electrical connection structures 164 each having a relatively small size and a core member 160.

Referring to FIGS. 4B and 4D, each of the radio frequency modules 100*f* and 100*h* may further include a heat dissipation member 151 and an adhesive member 152.

FIGS. 5A to 5D are lateral views illustrating a radio frequency module in which positions of an RFIC and an FEIC are changed with each other. Description of some elements with like reference numerals to the figures discussed above may be omitted hereafter.

Referring to FIGS. 5A to 5D, an RFIC 110 may be disposed on a lower surface of an interposer 170, and an FEIC 120 may be disposed on an upper surface of the interposer 170.

As the RFIC 110 has a size relatively larger than a size of the FEIC 120, and each of radio frequency modules 100*i*, 100*j*, 100*k*, and 100*l* may include a core member 160, a spacing distance between the interposer 170 and a substrate 200 may increase, and the RFIC 110 may be stably accommodated in each of the radio frequency modules 100*i*, 100*j*, 100*k*, and 100*l*.

Figure 5A:
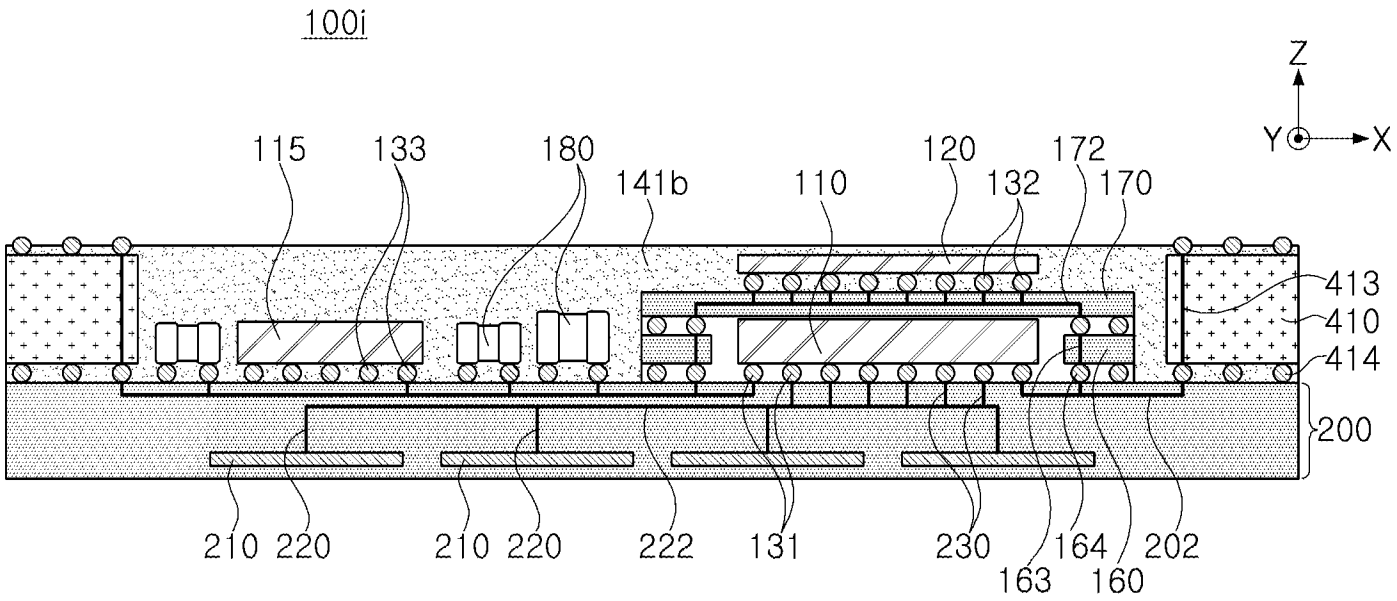
FIGS. 5A, 5B, 5C, and 5D are lateral views illustrating a radio frequency module in which positions of an RFIC and an FEIC are changed with each other, according to an example.
Figure 5B:
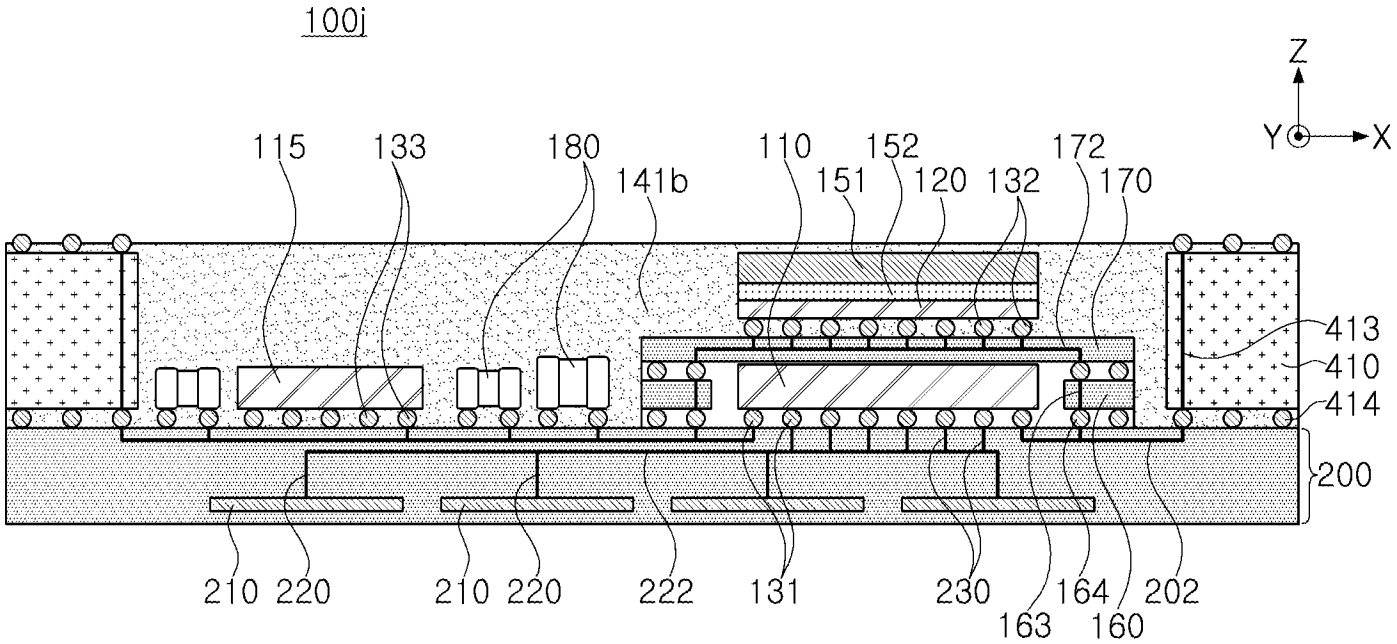

Referring to FIGS. 5A and 5B, each of the radio frequency modules 100*i* and 100*j* may include a sub-substrate 410.

Figure 5C:
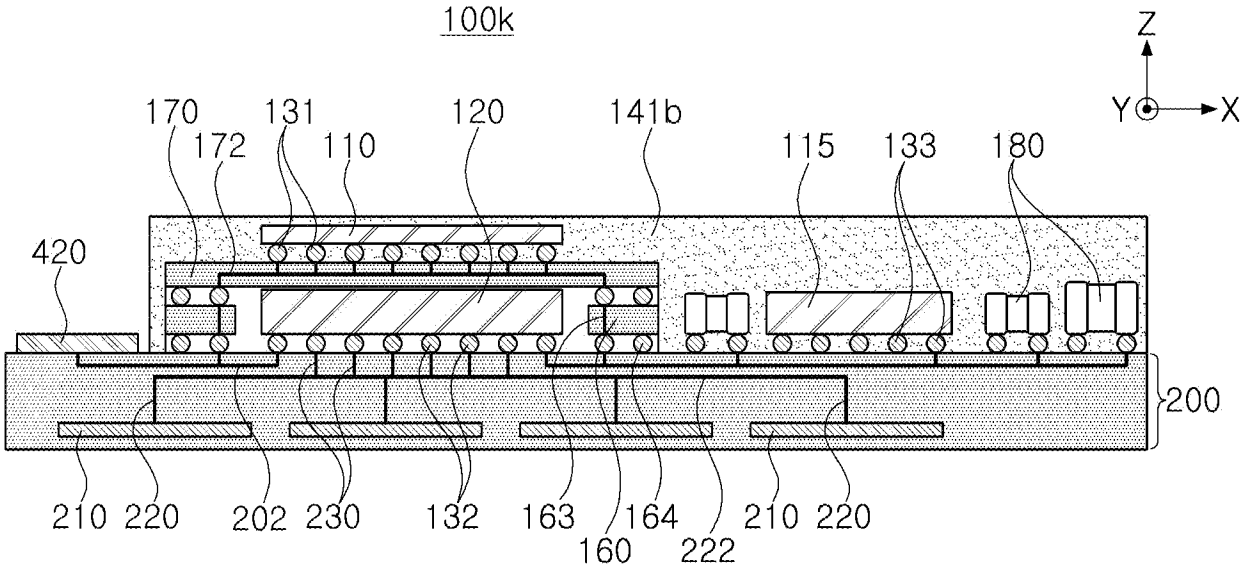
Figure 5D:
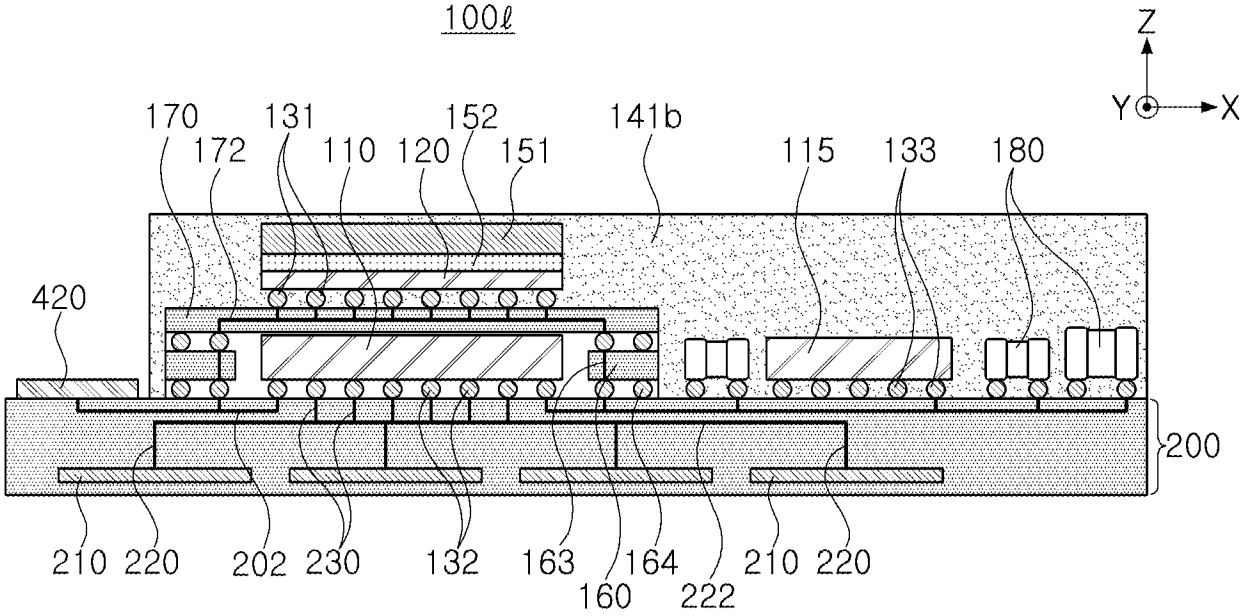

Referring to FIGS. 5C and 5D, each of the radio frequency modules 100*k* and 100*l* may include a connector 420.

Referring to FIGS. 5B and 5D, each of the radio frequency modules 100*j* and 100*l* may further include a heat dissipation member 151 and an adhesive member 152. Accordingly, the radio frequency modules 100*j* and 100*l* may emit heat from the RFIC 110 and also heat from the FEIC 120 through the heat dissipation member 151.

Figure 6:
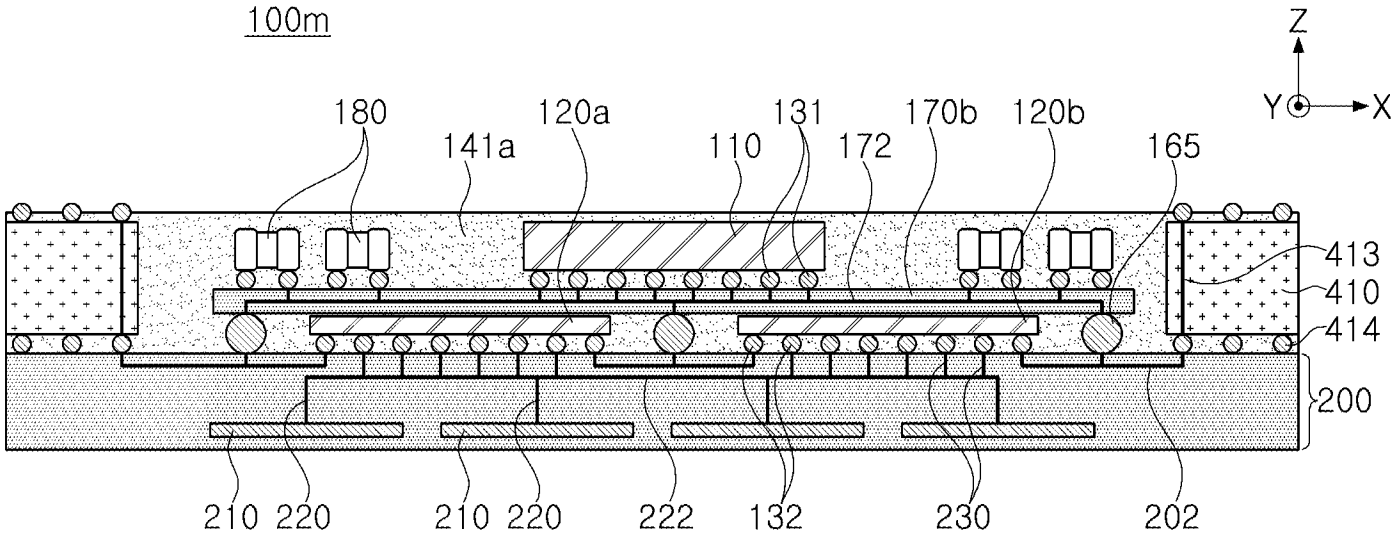
FIG. 6 is a lateral view illustrating a radio frequency module further including a second FEIC according to an example.

FIG. 6 is a lateral view illustrating a radio frequency module further including a second FEIC according to an example. Description of some elements with like reference numerals to the figures discussed above may be omitted hereafter.

Referring to FIG. 6, a radio frequency module 100*m* may include a first FEIC 120*a* and a second FEIC 120*b*. The first and second FEICs 120*a* and 120*b* may be implemented similarly to the FEIC described in the aforementioned examples, described with reference to FIGS. 1 to 5D.

The second FEIC 120*b* may input and/or output a third RF signal and a fourth RF signal having power different power of the third RF signal.

For example, a fundamental frequency of each of first and second RF signals input from and/or output to the first FEIC 120*a* may be different from a fundamental frequency of each of the third and fourth RF signals input from and/or output to the second FEIC 120*b*.

Accordingly, the radio frequency module 100*m* may support multi-frequency bands communications.

For example, the first FEIC 120*a* may output the second RF signal by amplifying the first RF signal, and the second FEIC 120*b* may receive the third RF signal and may output the fourth RF signal by amplifying the third RF signal. The RFIC 110 may convert a base signal into the first RF signal and may convert the fourth RF signal into the base signal.

The first FEIC 120*a* may be used for transmission, and the second FEIC 120*b* may be used for reception. Accordingly, each of the first FEIC 120*a* and the second FEIC 120*b* may not include a switch for conversion between transmission and reception, and thus, each of the first FEIC 120*a* and the second FEIC 120*b* may have a reduced size. Accordingly, a size of the radio frequency module 100*m* may be reduced.

For example, the plurality of electrical connection structures 165 may surround each of the first FEIC 120*a* and the second FEIC 120*b*.

Accordingly, the plurality of electrical connection structures 165 may stably support an interposer 170*b* even when a size of a lower surface of the interposer 170*b* is relatively large, and thus, stability of the radio frequency module 100*m* may improve.

Figure 7:
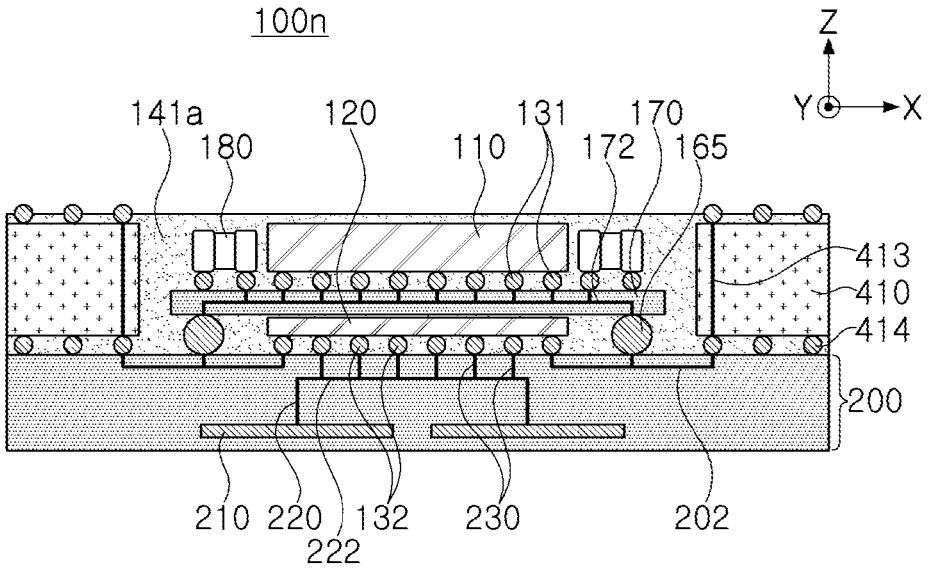
FIG. 7 is a lateral view illustrating a radio frequency module in which a passive component is disposed in an interposer according to an example.

FIG. 7 is a lateral view illustrating a radio frequency module in which a passive component is disposed in an interposer according to an example. Description of some elements with like reference numerals to the figures discussed above may be omitted hereafter.

Referring to FIG. 7, a radio frequency module 100*n* may have a structure in which a passive component 180 is disposed on an upper surface of an interposer 170, and the radio frequency module 100*n* may not include a PMIC.

Accordingly, a size of the radio frequency module 100*n* in a horizontal direction may easily be reduced.

Figure 8:
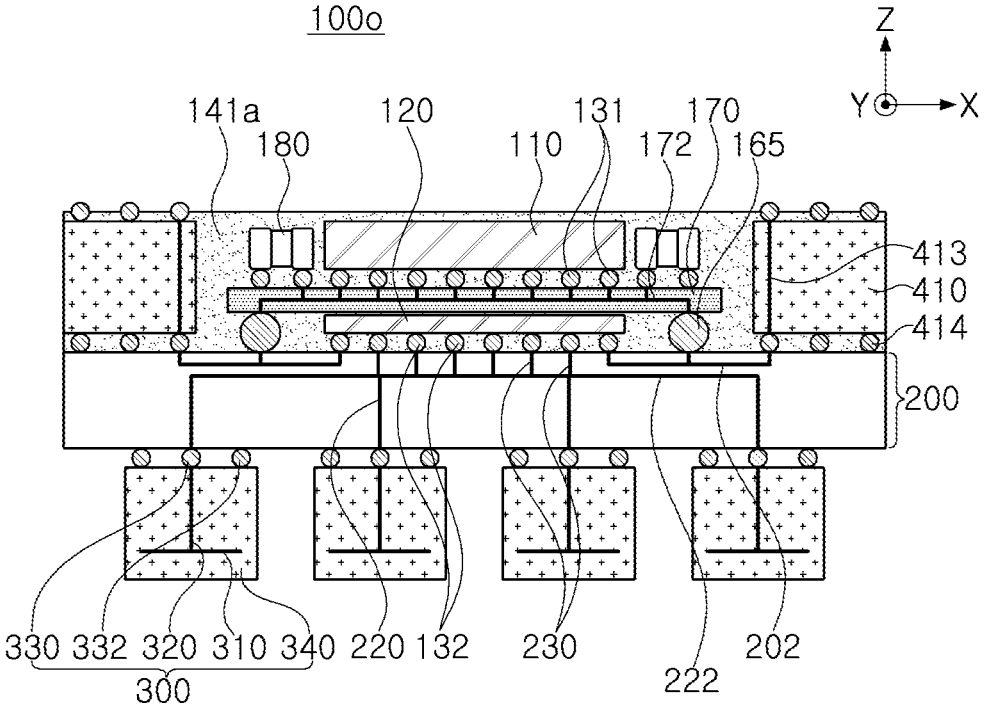
FIG. 8 is a lateral view illustrating a radio frequency module further including an antenna component according to an example.

FIG. 8 is a lateral view illustrating a radio frequency module further including an antenna component according to an example. Description of some elements with like reference numerals to the figures discussed above may be omitted hereafter.

Referring to FIG. 8, a radio frequency module 100*o* may include a patch antenna pattern 310 configured to transmit and receive first and second RF signals, and a feed via 320 configured to feed power to the patch antenna pattern 310, and may further include an antenna component 300 disposed on a lower surface of a substrate 200.

The antenna component 300 may form a radiation pattern in the −z direction through the patch antenna pattern 310.

For example, the antenna component 300 may further include a dielectric body 340 in addition to the patch antenna pattern 310 and the feed via 320, and may be mounted on a lower surface of the substrate 200 through a plurality of antenna electrical connection structures 330 and 332. A dielectric constant of the dielectric body 340 may more easily increase than a dielectric constant of an insulating layer of the substrate 200, and accordingly, the number of the antenna component 300 against a size of the radio frequency module 100*o* may increase. The higher the number of the antenna component 300 for a size of the radio frequency module 100*o*, the higher the gain of the radio frequency module 100*o* against a size of the radio frequency module 100*o* may be.

Figure 9:
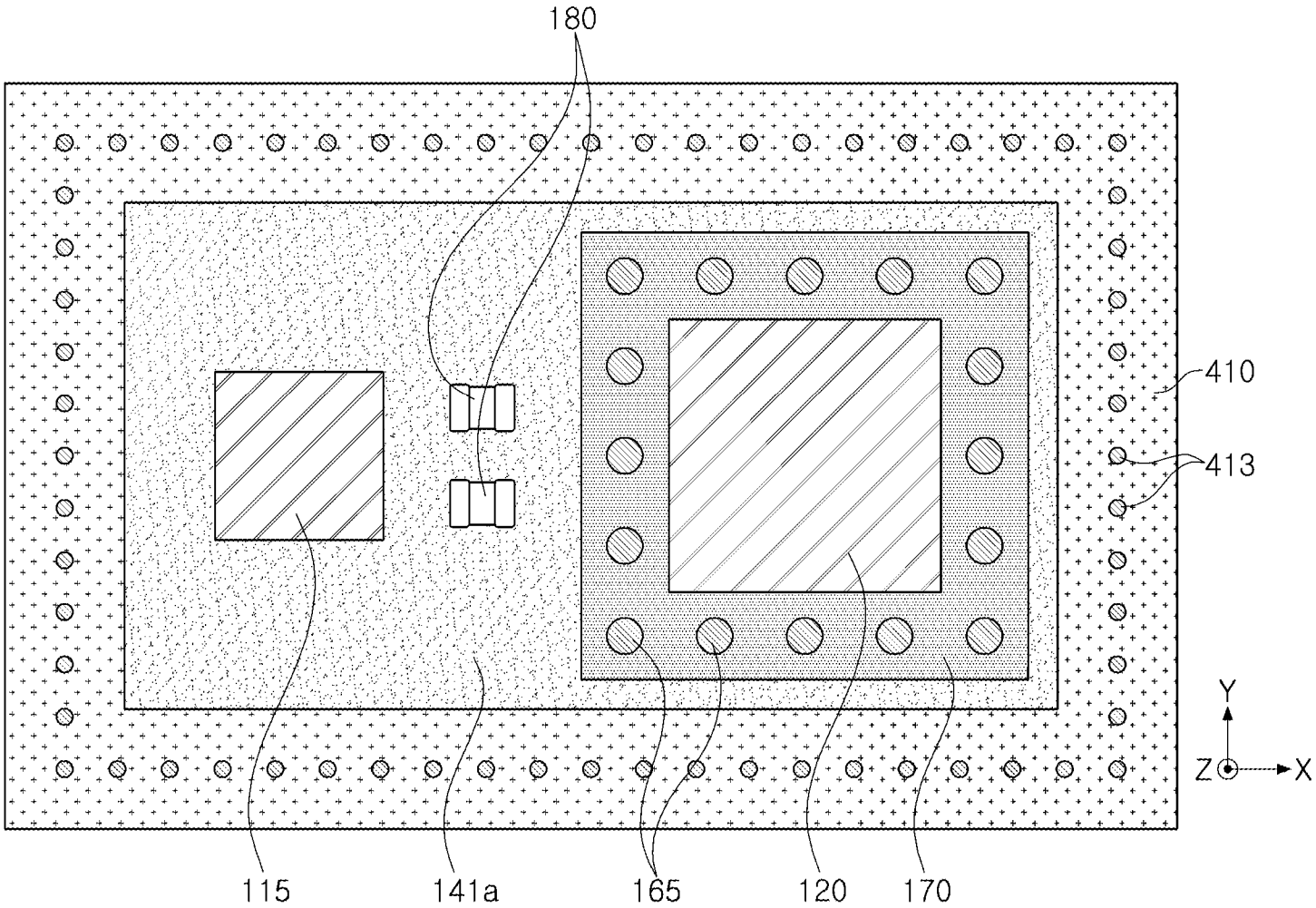
FIG. 9 is a plan view illustrating a radio frequency module in which a sub-substrate surrounds an interposer according to an example.

FIG. 9 is a plan view illustrating a radio frequency module in which a sub-substrate surrounds an interposer according to an example. Description of some elements with like reference numerals to the figures discussed above may be omitted hereafter.

Referring to FIG. 9, a plurality of electrical connection structures 165 may surround an FEIC 120, and a sub-substrate 410 may surround an interposer 170.

Figure 10:
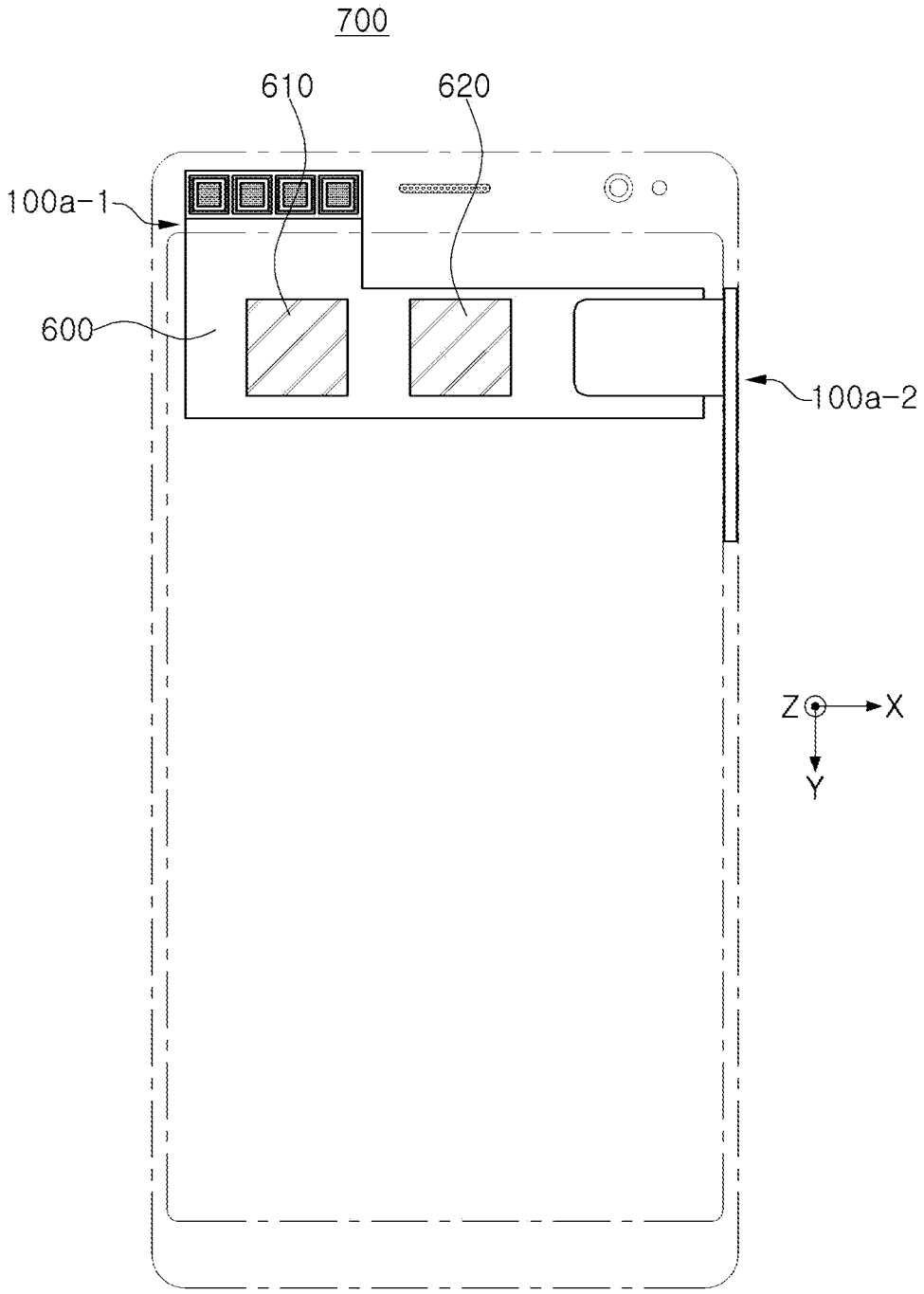
FIG. 10 is a plan view illustrating a radio frequency module disposed in an electronic device according to an example.

FIG. 10 is a plan view illustrating a radio frequency module disposed in an electronic device according to an example.

Referring to FIG. 10, radio frequency modules 100*a*-1 and 100*a*-2 may be disposed adjacent to a plurality of different edges of an electronic device 700, respectively.

The electronic device 700 may be implemented by a smartphone, a personal digital assistant, a digital video camera, a digital still camera, a network system, a computer, a monitor, a tablet PC, a laptop PC, a netbook PC, a television, a video game, a smart watch, an automotive component, or the like, but an example of the electronic device 700 is not limited thereto.

The electronic device 700 may include a base substrate 600, and the base substrate 600 may further include a communications modem 610 and a baseband IC 620.

The communications modem 610 may include at least some of a memory chip such as a volatile memory (e.g., a DRAM), a non-volatile memory (e.g., a ROM), a flash memory, or the like; an application processor chip such as a central processor (e.g., a CPU), a graphics processor (e.g., a GPU), a digital signal processor, a cryptographic processor, a microprocessor, a microcontroller, or the like; and a logic chip such as an analog-to-digital converter, an application-specific integrated circuit (ASIC), or the like.

The baseband IC 620 may generate a base signal by performing analog-to-digital conversion, and amplification, filtering, and frequency conversion on an analog signal. A base signal input to and output from the baseband IC 620 may be transferred to the radio frequency modules 100*a*-1 and 100*a*-2 through a coaxial cable, and the coaxial cable may be electrically connected to an electrical connection structure of the radio frequency modules 100*a*-1 and 100*a*-2.

For example, a frequency of the base signal may be a baseband, and may be a frequency (e.g., several GHz) corresponding to an intermediate frequency (IF). A frequency (e.g., 28 GHz or 39 GHz) of an RF signal may be higher than an IF, and may correspond to a millimeter wave (mmWave).

The wiring layers, the vias, and the patterns described in the aforementioned examples may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) method, a physical vapor deposition (PVD) method, a sputtering method, a subtractive method, an additive method, a semi-additive process (SAP), a modified semi-additive process (MSAP), or the like, but examples of the material and the method are not limited thereto.

The insulting layer in the examples may be implemented by prepreg, FR4, a thermosetting resin such as epoxy resin, a thermoplastic resin, a resin in which the above-described resin is impregnated in a core material, such as a glass fiber (or a glass cloth or a glass fabric), together with an inorganic filler, a Ajinomoto build-up film (ABF), bismaleimide triazine (BT), a photoimageable dielectric (PID) resin, a general copper clad laminate (CCL), or a ceramic-based insulating material, or the like.

The RF signal described in the various examples may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+ (HSPA+), high speed downlink packet access+ (HSDPA+), high speed uplink packet access+ (HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the above-mentioned protocols, but an example embodiment thereof is not limited thereto. Also, a frequency (e.g., 24 GHz, 28 GHz, 36 GHz, 39 GHz, or 60 GHz) of the RF signal may be higher than a frequency of an IF signal (e.g., 2 GHz, 5 GHz, 10 GHz, or the like).

According to the aforementioned examples, the radio frequency module may have improved processing performance (e.g., power efficiency, amplification efficiency, frequency conversion efficiency, heat dissipation efficiency, noise robustness, and the like) with respect to a radio frequency signal, or may have a reduced size.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A radio frequency module, comprising:

an interposer comprising at least one wiring layer;

a radio frequency integrated circuit (RFIC) disposed on a first surface of the interposer;

a front-end integrated circuit (FEIC) disposed on a second surface of the interposer opposite to the first surface; and electrical connection structures arranged to surround the FEIC and having at least a portion electrically connected to the at least one wiring layer, wherein the RFIC is configured to input or output a base signal and a first radio frequency (RF) signal having a frequency higher than a frequency of the base signal through the at least one wiring layer, and wherein the FEIC is configured to input or output the first RF signal and a second RF signal having power different from power of the first RF signal.

2. The radio frequency module of claim 1, wherein each of the electrical connection structures has a spherical shape or an atypical spherical shape, and wherein a thickness of the FEIC is less than a thickness of each of the electrical connection structures.

3. The radio frequency module of claim 1, further comprising:

mount electrical connection structures disposed on the first surface of the interposer and electrically connecting the at least one wiring layer to the RFIC, wherein a size of each of the electrical connection structures is greater than a size of each of the mount electrical connection structures.

4. The radio frequency module of claim 1, further comprising:

a core member surrounding the FEIC and including a core via, wherein at least one of the electrical connection structures is electrically connected to the core via on a surface of the core member.

5. The radio frequency module of claim 1, wherein the FEIC is configured to input or output the first and second RF signals in a direction opposite to the RFIC.

6. The radio frequency module of claim 1, further comprising:

a heat dissipation member disposed on a surface of the RFIC opposite to the interposer; and heat dissipation electrical connection structures arranged on a surface of the heat dissipation member opposite to the RFIC.

7. The radio frequency module of claim 1, further comprising:

a second FEIC surrounded by the electrical connection structures and configured to input or output a third RF signal and a fourth RF signal having power different from power of the third RF signal.

8. The radio frequency module of claim 1, further comprising:

a passive component disposed on the first surface of the interposer.

9. The radio frequency module of claim 1, wherein at least a portion of the FEIC overlaps at least a portion of the RFIC in a direction orthogonal to the first and second surfaces of the interposer.

10. A radio frequency module, comprising:

a radio frequency integrated circuit (RFIC) configured to input or output a base signal and a first radio frequency (RF) signal having a frequency higher than a frequency of the base signal;

a front-end integrated circuit (FEIC) configured to input or output the first RF signal and a second RF signal having power different from power of the first RF signal;

an interposer disposed between the RFIC and the FEIC and comprising at least one wiring layer;

a substrate disposed on a first surface of the interposer and having a first surface adjacent to the first surface of the interposer, the first surface of the substrate having a larger surface area than a surface area of the first surface of the interposer; and electrical connection structures electrically connecting the interposer to the substrate.

11. The radio frequency module of claim 10, wherein the substrate comprises:

a patch antenna pattern configured to transmit or receive the second RF signal; and a feed via configured to feed power to the patch antenna pattern.

12. The radio frequency module of claim 10, further comprising:

an antenna component disposed on a second surface of the substrate opposite to the first surface of the substrate, wherein the antenna component comprises:

a patch antenna pattern configured to transmit or receive the second RF signal;

a feed via configured to feed power to the patch antenna pattern; and a dielectric body surrounding the feed via.

13. The radio frequency module of claim 10, further comprising:

a power management integrated circuit (PMIC) disposed on the first surface of the substrate and configured to supply power to one or both of the FEIC and the RFIC through the substrate.

14. The radio frequency module of claim 10, further comprising:

mount electrical connection structures electrically connecting the FEIC to the substrate or electrically connecting the RFIC to the interposer, wherein a size of each of the electrical connection structures is greater than a size of each of the mount electrical connection structures.

15. The radio frequency module of claim 10, further comprising:

a sub-substrate disposed on the first surface of the substrate and surrounding the interposer; and outer electrical connection structures disposed on a surface of the sub-substrate opposite to the first surface of the substrate.

16. The radio frequency module of claim 15, further comprising:

a core member including a core via and surrounding the FEIC or the RFIC, wherein the electrical connection structures are disposed between the core member and the substrate.

17. The radio frequency module of claim 16, further comprising:

an encapsulant disposed on the first surface of the substrate and encapsulating at least a portion of the FEIC or the RFIC, wherein at least a portion of a space between the core member and the FEIC or the RFIC is filled with air.

18. The radio frequency module of claim 10, further comprising:

a heat dissipation member disposed on a surface of the RFIC or the FEIC opposite to the interposer;

heat dissipation electrical connection structures disposed on a surface of the heat dissipation member opposite to the RFIC or the FEIC; and an encapsulant disposed on the first surface of the substrate and encapsulating at least a portion of the RFIC or at least a portion of the FEIC.

19. The radio frequency module of claim 10, further comprising:

a connector disposed on the first surface of the substrate and configured to be connected to a cable.

* * * * *